US007804035B1

(12) United States Patent
Min

(10) Patent No.: US 7,804,035 B1
(45) Date of Patent: Sep. 28, 2010

(54) SWITCH MECHANISM, AND ASSOCIATED METHOD, FOR LIGHT ASSEMBLY OR OTHER ELECTRICAL DEVICE

(76) Inventor: Koeun Min, 3610 Gillespie St. #10, Dallas, TX (US) 75219

( * ) Notice: Subject to any disclaimer, the term of this patent is extended or adjusted under 35 U.S.C. 154(b) by 288 days.

(21) Appl. No.: 12/069,475

(22) Filed: Feb. 11, 2008

Related U.S. Application Data

(60) Provisional application No. 60/901,645, filed on Feb. 13, 2007.

(51) Int. Cl.
*H01H 9/00* (2006.01)

(52) U.S. Cl. ..... 200/310; 200/314

(58) Field of Classification Search ..... 200/310–314, 200/343–345, 538, 543–546
See application file for complete search history.

(56) References Cited

U.S. PATENT DOCUMENTS 2,436,748 A * 2/1948 Fanzoi ..... 200/61.77
6,002,093 A * 12/1999 Hrehor et al. ..... 200/345

* cited by examiner

*Primary Examiner*—Renee S Luebke
*Assistant Examiner*—Lisa Klaus

(57) ABSTRACT

An apparatus designed to suspend an electrical device such as a light bulb and to turn the light bulb on or off by exerting a force on the bulb itself, an encasing around the bulb, the conductive leads, or an extension thereof. When force is exerted, tension causes a tension bar actuator to actuate an electrical switch, thus turning the bulb on or off.

17 Claims, 3 Drawing Sheets

SWITCH MECHANISM, AND ASSOCIATED METHOD, FOR LIGHT ASSEMBLY OR OTHER ELECTRICAL DEVICE

CROSS-REFERENCE TO RELATED APPLICATION

The present invention claims the priority of provisional patent application No. 60/901,645, filed on Feb. 13, 2007, the contents of which are incorporated by reference. The present invention claims the benefit of design patent application No. 29/272,228 filed on Feb. 2, 2007 by the present inventor.

FIELD OF INVENTION

This present invention relates generally to an electrically-powered load-element, such as a pendant light assembly. More particularly, the present invention relates to a spring-mounted, tension-switch mechanism operable to electrically connect or disconnect an electrically-powered load element from a source of electrical power.

FEDERALLY SPONSORED RESEARCH

None.

SEQUENCE LISTING

None.

BACKGROUND OF THE INVENTION

Electricity is the motion of charged particles that create an electric charge. Early studies of electricity usually involved an electric charge that created some sort of light or arc. Ancient Greeks knew of electricity in the form of static when they rubbed objects against fur. When discharged, the static electricity would sometimes produce an arc. Perhaps the most documented historical event in this regard was when Benjamin Franklin, while studying lightening during a thunderstorm in his famous kite flying experiment, bridged the gap between lighting and static electricity. Studies such as these helped propel the theories in the minds of people such as Michael Faraday, Andre-Marie Ampere, George Sigmon Ohm, and Thomas Edison—inventor of the first commercially practical light bulb.

In order to power an electrical load element such as a light bulb, a circuit is needed to connect the electrical load element to a source of energy. A circuit consists of a number of electrical or electronic components connected by conductive materials. In order to power the electrical load element, the circuit needs a source of electrical energy such as alternating current energy, batteries, generators, etc. The circuit typically includes a switch, which controls the flow of the current, namely, it turns the electronic device on or off. The switch serves as a gateway to turning the electronic device on or off.

The earliest switch was simply the act of completing a circuit by connecting or disconnecting a wire. At its base form, a switch has two contacts that "close" to complete a circuit or "open" to disconnect the circuit. An example of an early switch is a lever switch, used by simply swinging a lever from the off position to the on position, or vice versa, to complete the circuit. These types of switches were used to power devices such as light bulbs to provide lighting in homes and businesses.

Electrical lighting provides more than just a utilitarian function. It is also used for aesthetic purposes. In the case of electronic devices such as a lighting fixture, attempts have been made and are being made to provide lighting devices that have not only a purposeful switch, but an aesthetically pleasing switch.

Today, conventional switches are of many varied configurations including the wall switch, the chain mounted rotary switch, dimmers, and the push button switch. However, each have their limitations in both utility and aesthetic qualities. Current methods for connecting or disconnecting an electrical load require one to engage the electronic fixture by touching the switch. For example, in order to turn the lights on in a room, one must engage a wall switch. To turn on a hanging light bulb in a basement, one must pull on a chain linked to a rotary switch. Known methods for connecting or disconnecting power to the light bulb do not allow one to engage the electrically-powered load element itself. The limitations of known methods will be discussed below.

The most common switch, the wall switch, is widely used in turning pendant or ceiling lights on and off in buildings. A wall switch is not located on the electrical device itself, but is place on the wall of a building in the general vicinity of the device. It is sometimes known as a "toggle" because it connects the circuit when toggled in one position, and disconnects when toggled in the opposite position.

A limitation with the use of a wall switch is that a single switch controls the supply of electricity to all lights in the circuit and as a result, all the lights must turn on or off together. It is difficult to turn on only one light bulb at a time on an as-needed or aesthetically pleasing basis. Using a wall switch, one would have to install a separate switch for each light bulb if that person only wanted to turn one light on at a time. Although it is currently a norm to have wall switches installed for lighting fixtures, many find it aesthetically unpleasant to have switches on walls as they hinder wall décor. Like many audio visual rooms found in schools and businesses, a separate switch for each light bulb could potentially lead to a wall full of switches which may detract from the aesthetics of a room. It is also difficult to find which wall switch engages which lighting element and as a result, one must engage each and every wall switch to find the correct light to engage.

A toggle switch attached to a light fixture may be used to remedy the problem of a wall full of switches, however, this device could not be a pendant or ceiling light, but must be a free-standing light fixture by its very nature. An attached toggle switch would allow one to turn lights on one at a time, however, the lighting fixture could not be a pendant or ceiling light simply because the attached toggle switch would be difficult to reach.

An embodiment of the current invention solves the problem of having to turn on all the pendant or ceiling lights in a room by allowing one to turn each hanging pendant light on or off independently without the use of unsightly wall switches or having to resort to free-standing light fixtures. This is made possible by the method of pulling on the pendant light fixture itself to turn the light on or off. One can possibly turn a single light on while leaving all other lights in the room off for purposes of ambience, for decreasing energy consumption, or for other utilitarian purposes in places such as a classroom.

Another version of an electric switch is simply the chain-mounted rotary switch found primarily in ceiling fans or on pendant light fixtures in a basement or closet. With these, one can turn a pendant or ceiling-attached electronic device on or off at its source, but not by pulling on the entire source itself. One must find the chain and pull on it to engage the switch. At times, finding the switch mechanism in a dark room can be a difficult challenge. The chain has been found to be unappealing and an annoyance. Currently, many ceiling fans are now using wall switches to control the fan, rather than these chain-mounted rotary switches because the chain has been found to be inconvenient. Pendant light fixtures with a chain mounted rotary switch have nearly been eliminated.

An embodiment of the present invention solves the problem of the annoyance of a chain on a chain-mounted rotary switch, but keeps the convenience of turning an electrically-powered load element on or off by pulling on the electrically-powered load element itself. It eliminates the chain and incorporates the switch mechanism with the device itself. It maintains the convenience of powering the device on or off by pulling on the device itself. One can simply pull on the electronic device, or an extension of the electronic device itself in order to turn the unit on or off. It would be easier finding the electronic device itself in a dark room, rather than a lone switch. Further, the pendant light would be aesthetically pleasing.

An embodiment of the present invention mechanically utilizes a push button switch in conjunction with a tension actuator bar and springs. Other versions of the present invention can use, but are not limited to, chain-mounted rotary switches, reed switches, wall mounted switches, dimmer switch, etc. The tension actuator bar is placed over the springs and push button switch and is balanced by stabilizing bars and bolts. The springs add resistance to the tension actuator bar in addition to the push button switch for smooth and reliable operation. Electrical wires are laced through the switch, tension actuator bar, and canopy to allow for the method of pulling the electrically-powered load element itself to turn the device on or off.

DETAILED DESCRIPTION

Figure 1:
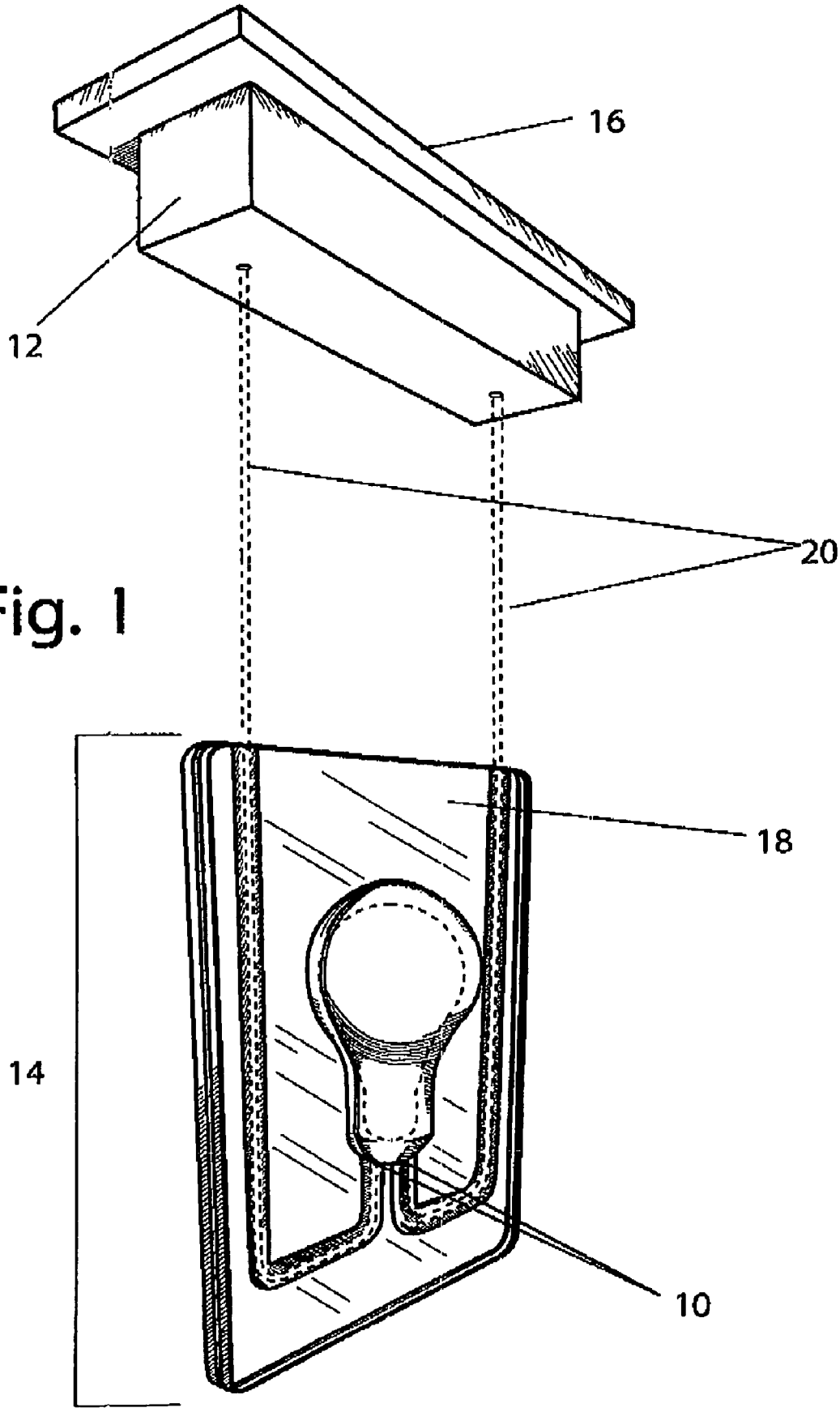
FIG. 1 illustrates a perspective view of an assembly of present invention.

FIG. 1 is a perspective view of an embodiment of a pendant light assembly. The assembly has a canopy encasing 12 and an electrically-powered load element 14 (which includes a heat resistant encasing 18 and the light bulb in the assembly) that is suspended by wires 20. The assembly includes, but is not limited to, canopy encasing 12. The purpose of canopy encasing 12 is to be aesthetically pleasing and non-essential but may also serve as a housing for electrical components in the assembly. Canopy encasing 12 is rectangular in the assembly, but may also be any shape such as a circle, triangle, rectangle, or any shape. Canopy encasing 12 may also include a canopy cover 16. In the assembly, canopy cover 16 is a polycarbonate material. Wires 20 extend from canopy encasing 12 and connect to an electrically-powered load element 14, as shown in the assembly. The assembly of the present invention may use wires 20 to suspend a heat resistant encasing 18 or electrically-powered load element 14, but it is not limited to wires 20 to suspend electrically-powered load elements. The assembly may also include, but is not limited to, a heat resistant encasing 18. Heat resistant encasing 18 allows electrically-powered load element 14 to stand upright to improve upon aesthetics. Heat resistant encasing 18 includes, but is not limited to, wire conduits that guide wires 20 to electrically-powered load element 14 and allowing it to hang upright. In the assembly, heat resistant encasing 18 includes, but is not limited to a rectangular shape. Other embodiments may include a variety of shapes such as circles, spheres, triangles, pyramids, etc. Electrically-powered load element 14 may be turned on or off by exerting pressure on electrically-powered load element 14, heat resistant encasing 18, wires 20, or any other extension thereof. The pressure exerted includes, but is not limited to, downward force, lateral force, upward force, or any force thereof.

Figure 2:
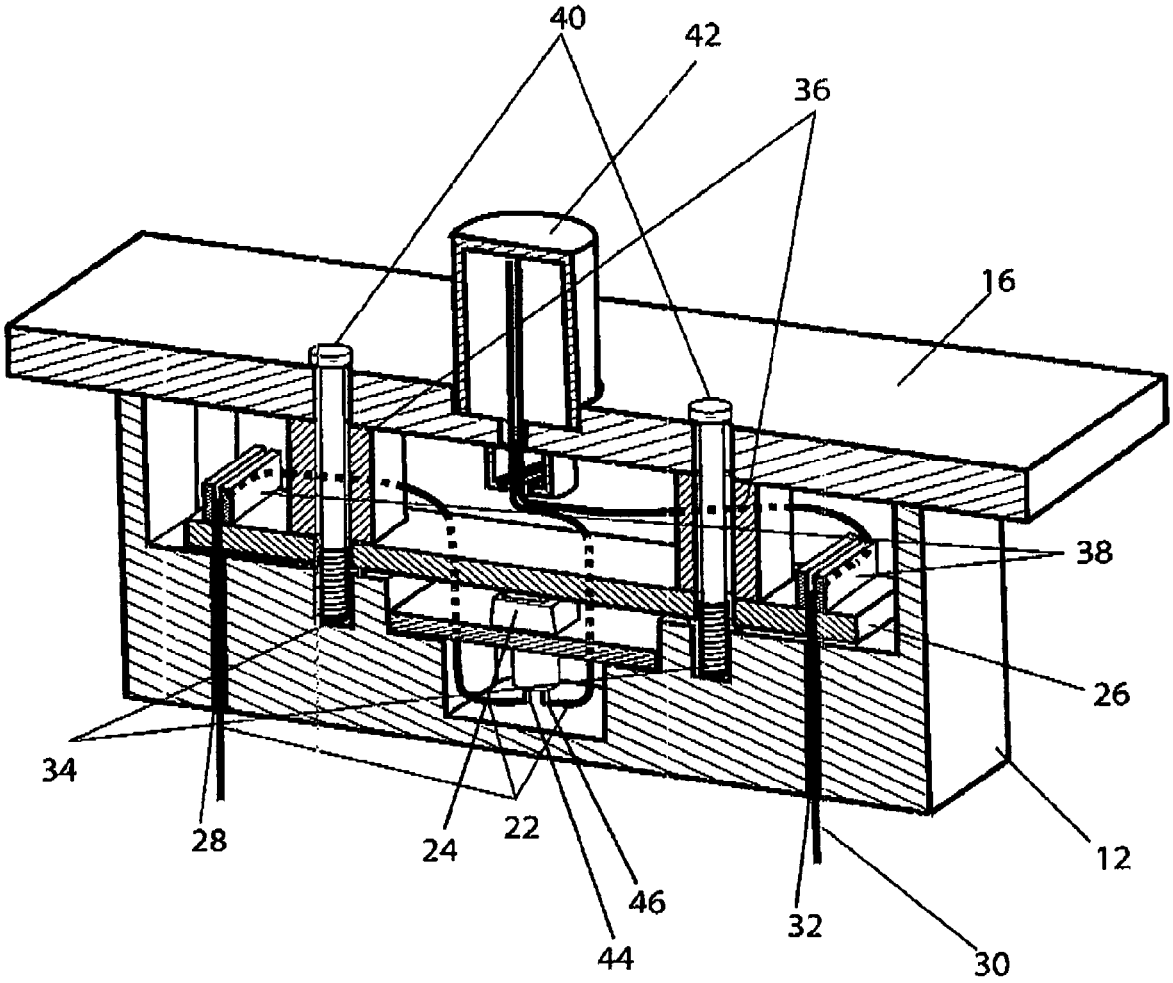
FIG. 2 illustrates a perspective lateral cut-away view of an assembly of switch mechanism

FIG. 2 is a perspective lateral cut-away view through canopy encasing 12 and canopy cover 16 constructed in accordance with an assembly of the present invention. A first wire 22 terminates and is electrically connected by first terminal of push button switch 44 and second terminal of push button switch 46 through a connection including, but not limited to, soldering. In this assembly a push button switch 24 is used, but other embodiments of switches such as rotary, reed, or other electromechanical switches may be used. An end of first wire 22 connects to a power source. The other end of first wire 22 is laced through an opening in tension bar actuator 26 and continues down through a first canopy wire exit 28 where the wire will ultimately connect to the terminals of an electrically-powered load element 10 (not shown in FIG. 2). Such a device may be, but is not limited to, a light bulb shown in FIG. 1. An end of a second wire 30 connects to a power source. Second wire 30 is laced through an opening in tension bar actuator 26 and continues down through a second canopy wire exit 32, where the wire will ultimately connect to said terminals of an electrically-powered load element 10 (not shown in FIG. 2). Spring(s) 34 underneath tension bar actuator 26 apply upward tension on tension bar actuator 26. Tension bar actuator 26 extends above spring(s) 34 and over push button switch 24 in such a way that tension bar actuator 26 does not actuate push button switch 24 until a physical pressure is applied. Spring(s) 34 support tension bar actuator 26 to limit actuation until a physical pressure is applied. Stabilizing spacer(s) 36 may be placed on top of tension bar actuator 26 for purposes of allowing spring(s) 34 to apply the correct amount of tension on tension bar actuator 26. A tension clip 38 may be placed on first wire 22 above and resting on tension bar actuator 26. Another tension clip 38 may be placed on second wire 30 above and resting on tension bar actuator 26. Tension clip 38 allows for equalized physical tension to be applied to tension bar actuator 26 and aids in the aesthetic alignment of an electrically-powered load element (not pictured in FIG. 2). Bolt(s) 40 may be placed through stabilizing spacer(s) 36, tension bar actuator 26, and spring(s) 34 in order to align the assembly of the invention correctly. In the present exemplary embodiment, canopy cover 16 includes an upstanding adapter 42 that in this implementation facilitates support of the invention in a track for track lighting.

Figure 3:
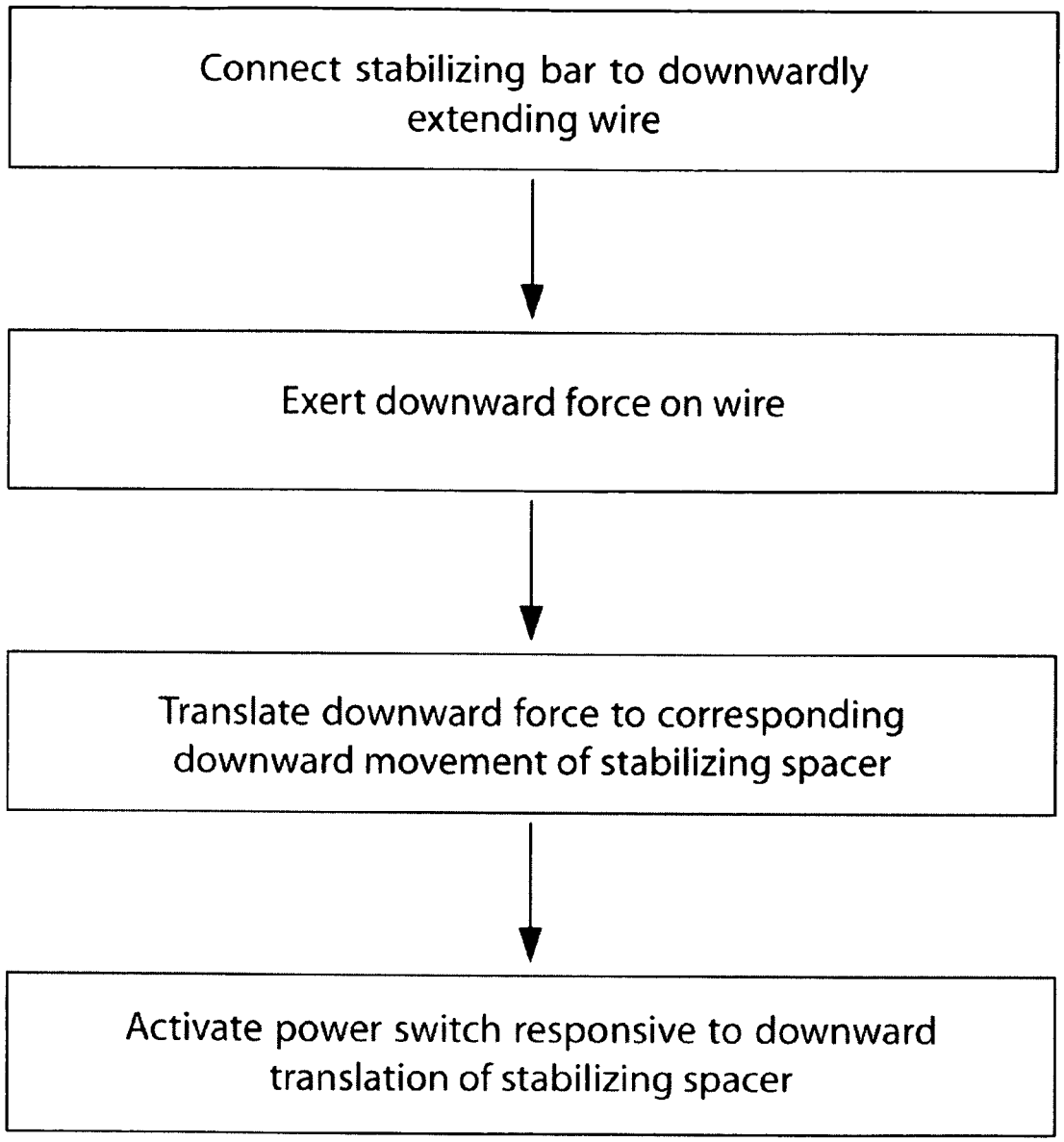
FIG. 3 illustrates a flow chart of the method for electrically connecting or disconnecting electrically-powered load element.

FIG. 3 shows operation pursuant to an embodiment of the present invention, when a force is exerted on the heat resistant encasing 18, pendant light fixture 14, wires 20, or any extension thereof, the device is turned on or off. The physical force exerts force on wire(s) 20. Force translates to tension exerted on the tension bar actuator 26 by means of tension clip(s) 38. Tension bar actuator 26 actuates power switch when correct amount of pressure is applied to push button switch 24. Spring(s) 34 applies opposing force on tension bar actuator 26 allowing for completion of push button switch 24 once physical force is released.

Additional embodiments can include, but is not limited to, the use of only one spring 34, or a different element offering opposing force. Other embodiments not include unnecessary elements such as canopy casing 12, canopy cover 16, heat resistant encasing 18, stabilizing spacer 36, bolt 40, or upstanding adapter 42. These elements add to aesthetics and efficient operation, but are not necessary for a working unit.

REFERENCE NUMERALS

10. Terminals of an electrically-powered load element
12. Canopy Encasing
14. Electrically-powered load element
16. Canopy Cover
18. Heat resistant encasing
20. Wires
22. First Wire
24. Push Button Switch
26. Tension Bar Actuator
28. First Canopy Wire Exit
30. Second Wire
32. Second Canopy Wire Exit
34. Spring(s)
36. Stabilizing Spacer
38. Tension Clip
40. Bolt(s)
42. Upstanding Adapter
44. First Terminal of Push Button Switch
46. Second Terminal of Push Button Switch

I claim:

1. A mechanism for suspending, activating, and deactivating an electrically-powered load element comprising:

an electrically-powered load element;

a push button switch;

a plurality of wires;

a tension bar actuator sufficient in size to activate said switch and sufficient in strength to support said electrically-powered load element;

at least one spring sufficient in strength to support said tension bar actuator and suspend said electrically-powered load element;

said springs being placed in proximity of said switch and said tension bar actuator placed on top of said springs so that said springs create an equidistant space between said tension bar actuator and said switch; and said wires, one of which being connected to a first terminal of the push button switch, interwoven through said tension bar actuator and connected to the terminals of an electrically-powered load element and another of said wires being attached to a second terminal of push button switch connecting to electrical source, and another of said wires connected to electrical source interwoven through said tension bar actuator and connected to said terminals of an electrically-powered load element.

2. The mechanism of claim 1 wherein said electrically-powered load element includes a light bulb contained in a heat resistant encasing.

3. The mechanism of claim 1 wherein said electrically-powered load element includes a Light Emitting Diode (LED).

4. The mechanism of claim 1 wherein said electrically-powered load element includes a light bulb with heat resistant attachment to said light bulb.

5. The mechanism of claim 1 wherein said tension bar actuator is made of metal.

6. The metal in claim 1 wherein said tension bar actuator is rectangular in shape.

7. The mechanism of claim 1 wherein said tension bar actuator is made of organic material.

8. The mechanism of claim 1 wherein said springs include two springs set on either side of said switch.

9. A support assembly for an electrically-powered load element, said support assembly comprising:

an actuable switch element switchingly positionable in an open position and closed position;

a force-receiving tension bar actuator configured to be responsive to application of a switch positioning force to activate said switch;

a set of conductive leads electrically connected to said switch and engaged with said force-receiving tension bar actuator; and a load-element support supported by said set of conductive leads;

said load-element support configured to support the load-element and to receive an actuation force that, when applied to said force-receiving tension bar actuator by way of a conductive lead of said set, forms the switch positioning force.

10. The support assembly of claim 9 wherein the load-element comprises a light bulb and wherein said load-element support is configured to support the light bulb.

11. The support assembly of claim 9 wherein said force-receiving tension bar actuator is configured to abut against said actuable switch element, application of the switch-positioning force to said force-receiving tension bar actuator.

12. The support assembly of claim 9 wherein said set of conductive leads comprises a first conductive lead and a second conductive lead spaced apart therefrom.

13. The support assembly of claim 12 wherein said set of conductive leads provides the load-element with operative power when said actuable switch is in the closed position.

14. The support assembly of claim 9 wherein said actuable switch element comprises a single-pole, single-throw switch.

15. The support assembly of claim 9 wherein said set of conductive leads are configured to hang beneath said force-receiving tension bar actuator.

16. The support assembly of claim 9 wherein said load-element support is supported by said set of conductive leads to hang beneath said force-receiving tension bar actuator.

17. The support assembly of claim 9 further comprising a spring element configured to abut against said force-receiving tension bar actuator to apply a spring generated tension force thereagainst.

* * * * *